United States Patent [19]

Beretta et al.

[11] 4,148,657

[45] Apr. 10, 1979

[54] SILVER HALIDE PHOTOGRAPHIC EMULSIONS REACTIVELY ASSOCIATED WITH ANTIFOG AGENTS, AND PHOTOGRAPHIC ELEMENTS CONTAINING SAID EMULSIONS

[75] Inventors: Paolo Beretta, Ferrania; Luigi Danello, Vado Ligure, both of Italy

[73] Assignee: Minnesota Mining and Manufacturing Company, Saint Paul, Minn.

[21] Appl. No.: 843,688

[22] Filed: Oct. 19, 1977

[51] Int. Cl.[2] ..... G03C 1/40; G03C 1/34

[52] U.S. Cl. ..... 96/100 R; 96/109; 96/95; 96/56; 96/66.5

[58] Field of Search ..... 96/109, 100, 66.5, 56, 96/94 R, 95

[56] References Cited

PUBLICATIONS

Birr, Stabilization of Photographic Silver Halide Emulsions, The Focal Press, Apr. 3, 1975, p. 69.

Kalenda, et al., Ser. No. 788,076, laid open to public inspection on Apr. 22, 1969, as noted at 861 OG1021, p. i, pp. 3, 7, 8.

*Primary Examiner*—Won H. Louie, Jr.

*Attorney, Agent, or Firm*—Cruzan Alexander; Donald M. Sell; Mark A. Litman

[57] ABSTRACT

Hexahydro-4,6-diimino-1,3-pyrimidine-2-thiones having a phenyl group substituent in the 1-position have been found to be antifoggants for silver halide photographic emulsions.

6 Claims, No Drawings

SILVER HALIDE PHOTOGRAPHIC EMULSIONS REACTIVELY ASSOCIATED WITH ANTIFOG AGENTS, AND PHOTOGRAPHIC ELEMENTS CONTAINING SAID EMULSIONS

The present invention relates to silver halide photographic emulsions reactively associated with antifog agents and to photographic elements containing said emulsions.

Fog is one of the fundamental problems in photography, both in black and white or color photography.

Fog is the undesired formation of developed silver, or of developed dye in the case of color photography, in non-exposed areas.

Such fog is related to the fact that the sensitivity centers of the silver halide grains usually are like the fog centers and that fog is generally increased when it is tried to increase the emulsion sensitivity. This tends to impair the quality of the obtained photographic material with regard to fog.

In color photography the problem can be more serious, since colored fog is generally more visible than black and white fog.

The problem of both black and white and color fog may be reduced with substances that decrease fog rather than sensitivity. Such substances are to be reactively associated with the photographic emulsion by introducing them either into the layer containing said emulsion, into a layer adjacent thereto, or into the developing bath.

Antifog agents have been described since the beginning of photography (e.g., *Stabilization of Photographic Silver Halide Emulsions,* by E. J. Birr, Focal Press).

In particular, antifog agents used in a manner like those of the present invention were described in U.S. Pat. No. 2,304,962 and in Fr. Pat. application No. 2,005,204.

The present invention relates to a silver halide photographic emulsion reactively associated with an antifog agent of the following formula:

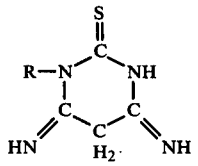

wherein R represents a substituted or non-substituted phenyl group. Useful substituents would include o—, m—, and p-substituents of halogen (I, Cl, and Br) and low alkyl and low alkoxy groups (having 1 to 5 C atoms) such as p-chlorine; p-methyl; p-methoxy; 2,6-dimethyl..

The present invention preferably refers to a silver halide photographic emulsion reactively associated with an antifog agent (which can be introduced also into a layer adjacent to the emulsion itself or into the developing bath), as described above, wherein R is phenyl or is phenyl substituted with a halogen atom.

The present invention further refers to a photographic element comprising a supporting base and an emulsion as described above, and in particular to a silver halide emulsion associated with a coupler to form colored images.

The supporting base of said element may be any base known in the art, such as e.g. cellulose triacetate, polyester, paper, polytenated paper.

The couplers used in color photographic emulsion may be those usually employed in the substractive color photographic art, i.e. couplers which upon reaction with p-phenylene diamine developers form a cyan dye (e.g., phenolic or naphtholic couplers), a yellow dye (e.g., benzoylacetanilide or pivalylacetanilide couplers), or a magenta dye (e.g., 5-pyrazolone couplers), respectively.

The following examples show the synthesis and use of compounds of the present invention.

EXAMPLE 1

Hexahydro-1-phenyl-4,6-diimino-1,3-pyrimidine-2-thione.

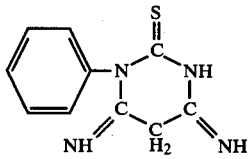

To a solution of 10.12 g (0.44 mole) of metallic sodium in 240 ml of absolute ethanol were added 60.8 g (0.40 mole) of N-phenylthiourea and 26.4 g (0.40 mole) of malonic nitrile under efficient stirring. The solution thus obtained was refluxed under stirring for 10 hours. After cooling at 40° C. the orange preciptitate was collected on a buchner, washed thoroughly with ethanol and dried. The resulting product was poured into 700 ml of deionized water and a solution was formed by the slow addition of 30 ml of conc. hydrochloric acid and 25 ml water. The obtained solution was filtered and treated with a solution of ammonium hydroxide and water until the pH was approximately equal to 10. After stirring and cooling for two hours the product was filtered on a buchner and thoroughly washed with deionized water.

Yield: 22.7 g of white powder, having M.P. = 249–251° C.

| Percent analysis: | Calculated | Found |
|---|---|---|
| C% | 55.03 | 54.99 |
| H% | 4.62 | 4.64 |
| N% | 25.67 | 25.69 |
| S% | 14.69 | 14.74 |

EXAMPLE 2

Hexahydro-1-(p-chloro)-phenyl-4,6-diimino-1,3-pyrimidine-2-thione.

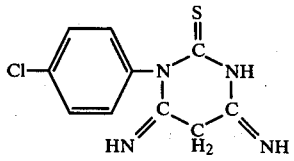

The compound was prepared according to the procedure of Example 1 using 2.0 g of metallic sodium dissolved in 100 ml of absolute ethanol, 15 g N-p-chlorophenyl-thiourea and 5.3 g of malonic nitrile. The product obtained after the acid-base purification yielded 3.1 g. M.P. = 260–262° C./dec.

| Percent analysis: | Calculated | Found |
|---|---|---|
| C% | 47.43 | 47.48 |
| H% | 3.59 | 3.62 |
| N% | 22.17 | 22.29 |

The following compounds are antifog compounds outside the scope of the present invention and herein considered only for comparative purposes.

Compound A:

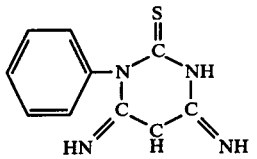

Hexahydro-1-phenyl-4,6-diimino-s-triazine-2-thione

Compound B:

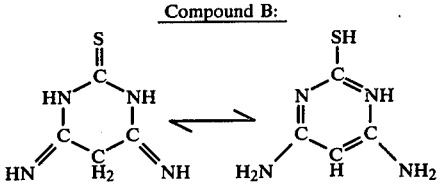

Hexahydro-4,6-diimino-1,3-pyrimidine-2-thione or 2-mercapto-4,6-diamino-1,3-pyrimidine Compound C:

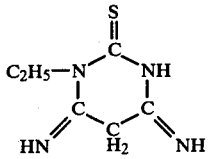

Hexahydro-1-ethyl-4,6-diimino-1,3-pyrimidine-2-thione

Compound C was prepared according to the procedure of Example 1 using 13.8 g of metallic sodium dissolved in 150 ml of absolute ethanol, 20.8 g of N-ethylthiourea and 13.2 g of malonic nitrile. After an acid-base treatment and a recrystallization from water, 5.0 g of pure product were obtained, having M.P. = 198–201° C.

| Percent analysis: | Calculated | Found |
|---|---|---|
| C% | 42.33 | 42.25 |
| H% | 5.92 | 5.91 |
| N% | 32.91 | 33.18 |

The following examples are practical examples of the present invention in which significant obtained data are reported.

EXAMPLE 4

A gold and sulfur chemically sensitized silver bromochloride emulsion containing a trinuclear red spectral sensitizer 2-[1'-(4''-sulpho)-butyl-4'-methyl-pyrido-[1,2-b]-benzimidazole-2'-methylene-anhydrous hydroxide]-3-ethyl-5-[3''-4''-5''-diphenyl-thiazoline]-2''-ethylidene]-(4)-thiazolidone and a dispersed cyan coupler was adjusted to approximately 4% of silver at ratio silver/-gelatin ≃ 0.5. A control sample of this emulsion and samples to which had been added with the concentrations of example 1, 2 and of compound C, as shown in Table I, were coated on a polyester film support at a coating weight of approximately 0.70 g of silver per square meter.

A sample of each coating was exposed on a sensitometer and developed for 3 minutes and 30 seconds at 36° C. in a developer having the following composition:

| | |
|---|---|
| Anhydrous sodium-sulfite | 4.35 g |
| 2-amino-5-diethylamino-toluene monohydrochloride | 2.95 g |
| Anhydrous sodium carbonate | 17.1 g |
| Sodium bromide | 1.72 g |
| Nitrilo-N,N,N-trimethylen-phosphonic acid | 1.0 ml |
| Water to have | 1,000 ml |

The developed film was bleached, fixed and dried. The following results have been described in Table I wherein the speed is expressed relatively as the reciprocal of the exposure needed to give a density of 1.0 above fog and the contrast ($\gamma_M$) is given between d = 0.9 and d = 2.1.

TABLE I

| | g/mole | Fresh | | | 24 Hrs. Storage at 70° C., 60% RH | | |
|---|---|---|---|---|---|---|---|
| | Ag | Speed | Fog | $\gamma_M$ | Speed | Fog | $\gamma_M$ |
| CONTROL | | 100 | 0.99 | 1.80 | (–) | 1.25 | (–) |
| Ex. No. 1 | 0.08 | 70 | 0.47 | 3.34 | 68 | 0.23 | 2.10 |
| | 0.16 | 65 | 0.31 | 3.95 | 68 | 0.07 | 3.16 |
| Ex. No. 2 | 0.09 | 65 | 0.37 | 3.65 | 63 | 0.15 | 2.66 |
| | 0.18 | 60 | 0.24 | 4.07 | 65 | 0.08 | 3.42 |
| Comp. C | 0.06 | 65 | 0.81 | 2.42 | (–) | 1.25 | (–) |
| | 0.12 | 60 | 0.96 | (–) | (–) | 1.35 | (–) |

N.B.:
The sign (–) means that there was no purpose in measuring speed and $\gamma_M$ values as defined, in the presence of such high fog levels.

EXAMPLE 5

Different portions of bromo-chloride emulsion containing about 4% of silver, chemically sensitized with gold and sulfur, spectrally sensitized with a trinuclear red sensitizing dye and containing also a dispersed phenolic cyan coupler, were added respectively with compound of Example No. 1 of the present invention and with the reference prior art compounds A and B. Samples of these coatings were exposed, developed and worked out as described in example No. 4. The results are reported in Table II.

TABLE II

| | g/mole | Fresh | | | 24 Hrs. Storage at 70° C., 60% RH | | |
|---|---|---|---|---|---|---|---|
| | Ag | Speed | Fog | $\gamma_M$ | Speed | Fog | $\gamma_M$ |
| CONTROL | | 100 | 0.26 | 2.81 | 70 | 0.33 | 2.40 |
| Ex. No. 1 | 0.08 | 100 | 0.11 | 3.23 | 75 | 0.30 | 2.42 |
| | 0.16 | 98 | 0.07 | 3.41 | 71 | 0.06 | 2.56 |
| Comp. A | 0.054 | 103 | 0.21 | 2.46 | (–) | 1.32 | (–) |
| | 0.108 | 85 | 0.12 | 2.29 | (–) | 1.90 | (–) |
| Comp. B | 0.08 | 98 | 0.16 | 2.95 | 72 | 0.41 | 2.21 |
| | 0.16 | 92 | 0.12 | 3.16 | 61 | 0.20 | 2.56 |

N.B.:
The sign (–) has the same meaning as that of the previous example.

What we claim is:

1. A photographic element comprising a supporting base and a photographic silver halide emulsion layer on said base, and in said emulsion layer or in a layer adjacent to said emulsion layer an anti-fogging amount of a compound of the following formula:

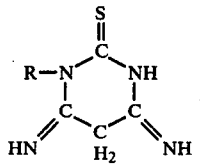

wherein R represents a phenyl group.

2. The photographic emulsion according to claim 1 in which R is phenyl.

3. Photographic element according to claim 1 in which said emulsion containing a coupler to form colored images.

4. The photographic emulsion of claim 1 in which R is o-, m-, or p- monohalogen substituted.

5. The photographic emulsion of claim 1 in which R is p-monohalogen phenyl.

6. The photographic emulsion of claim 1 in which R is substituted only in the p-position.

* * * * *